US006562162B1

(12) United States Patent
Iredi et al.

(10) Patent No.: US 6,562,162 B1
(45) Date of Patent: May 13, 2003

(54) METHOD AND DEVICE FOR PRODUCING SHAPED BODIES

(75) Inventors: Hans-Joachim Iredi, Bad Muender (DE); Ove-Walter Cornils, Springe (DE); Hubertus Japes, Bad Muender (DE); Klaus Linde, Pohle (DE); Franz-Josef Wilbois, Welliehausen (DE)

(73) Assignee: Valmet Panelboard GmbH, Hannover (DE)

( * ) Notice: Subject to any disclaimer, the term of this patent is extended or adjusted under 35 U.S.C. 154(b) by 0 days.

(21) Appl. No.: 09/700,622

(22) PCT Filed: Apr. 30, 1999

(86) PCT No.: PCT/EP99/02955

§ 371 (c)(1),
(2), (4) Date: May 2, 2001

(87) PCT Pub. No.: WO99/59788

PCT Pub. Date: Nov. 25, 1999

(30) Foreign Application Priority Data

May 19, 1998 (DE) ..... 198 22 487
Sep. 7, 1998 (DE) ..... 198 40 818

(51) Int. Cl.[7] ..... B27N 3/18
(52) U.S. Cl. ..... 156/62.2; 156/497; 264/109
(58) Field of Search ..... 156/62.2, 296, 156/497, 82; 264/83, 109

(56) References Cited

U.S. PATENT DOCUMENTS

| | | | | |
|---|---|---|---|---|
| 4,293,509 A | | 10/1981 | Buecking | 264/26 |
| 5,063,010 A | * | 11/1991 | Fischer et al. | 264/109 |
| 5,158,012 A | * | 10/1992 | Gawlitta et al. | 100/38 |
| 5,195,428 A | * | 3/1993 | Gawlitta et al. | 100/73 |
| 5,603,881 A | | 2/1997 | Hanna | 264/123 |
| 5,643,376 A | * | 7/1997 | Gerhardt et al. | 156/62.2 |
| 5,733,396 A | * | 3/1998 | Gerhardt et al. | 156/62.2 |
| 5,762,980 A | * | 6/1998 | Bielfeldt | 425/371 |

FOREIGN PATENT DOCUMENTS

| | | |
|---|---|---|
| DE | 364082 A1 | 6/1988 |
| DE | 3640682 A1 | 6/1988 |
| DE | 3914106 A1 | 10/1990 |
| DE | 19701596 A1 | 8/1997 |

OTHER PUBLICATIONS

Kollmann, Franz, *Holzspanwerkstoffe*, Springer Verlag, Berlin, 1966, p. 371.

* cited by examiner

*Primary Examiner*—James Sells
(74) *Attorney, Agent, or Firm*—Townsend and Townsend and Crew LLP

(57) ABSTRACT

A method and apparatus for manufacturing shaped bodies made of fibers, particles containing cellulose and/or particles containing lignocellulose which are admixed with a binder and scattered to form a mat. The mat is preheated by supplying thermal energy from an interior of the mat outwardly to a surface of the mat and then pressing the mat into the shaped body.

30 Claims, 7 Drawing Sheets

METHOD AND DEVICE FOR PRODUCING SHAPED BODIES

BACKGROUND OF THE INVENTION

A method is described of manufacturing shaped bodies, in particular fiberboard, chipboard or like boards, in which fibers, particles containing cellulose or particles containing lignocellulose are scattered with an admixed binder to form a mat and preheated before the mat is pressed to the shaped body, while supplying heat and pressure. Furthermore, the invention is directed to an apparatus for the manufacture of shaped bodies, in particular of fiberboard, chipboard, or like boards, in particular for carrying out the method of the present invention, comprising a scattering station, a forming line, a pressing station and a heating device inserted before the pressing station for the heating of a mat scattered by the scattering station onto the forming line prior to entry into the pressing station.

An apparatus of this kind, and also a corresponding method, are known from DE-PS 39 14 106. In the apparatus described in this document, the heating device is arranged in the region of the entry drum of the pressing station, in order, in this manner, to increase the output of shaped bodies, or to reduce the length of the press for a given output.

The disadvantage of such an apparatus is the fact that a relatively large quantity of thermal energy must be supplied to the mat, both in the heating device and also in the pressing station, and that the speed of transport of the mat may not exceed a certain maximum speed, because otherwise a complete heating of the mat over its full cross-section is not possible.

SUMMARY OF THE INVENTION

It is an object of the invention to so design a method and an apparatus of the initially named kind that the thermal energy to be supplied can be reduced with a uniform through-heating of the mat simultaneously being maintained. It is a further object to so further develop a method and an apparatus of the initially named kind that these can be used even more flexibly and in particular the output of shaped bodies can be increased or, with a given output, the length of the apparatus reduced.

The part of the object relating to the method is solved, starting from a method of the initially named kind, in that the preheating of the mat, consisting of the precompressed or pressed fibers or like particles, takes place by the supply of thermal energy from the interior of the mat outwardly to the surface of the mat. Correspondingly, the part of the object relating to the method is solved, in an apparatus of the initially named kind, in that the heating device is formed for the supply of heat from the interior of the mat outwardly towards the surface of the mat.

Thus, whereas the thermal energy of both the heating device and also of the pressing station is supplied in the arrangement of DE 39 14 106 from the outer sides of the mat in the direction towards the interior of the mat, the direction of supply of the thermal energy in the heating device in accordance with the invention is reversed.

Since the heat supplied to the mat in the pressing station via the press rollers takes place from the outer sides towards the interior of the mat, it is more favorable to already heat the interior of the mat in the preheating phase, whereas a heating of the outer sides is not so important. Through the combination of preheating from the inside towards the outside and a thermal treatment from the outside towards the inside within the pressing station, it is ensured that the mat is fully and uniformly heated over its entire cross-section.

Furthermore, the loss of the thermal energy supplied, which occurs on the path between the heating device and the pressing station, is significantly smaller when the mat has a "hot core" than when the mat is heated via its outer sides in the heating device.

Accordingly, an energy saving can be achieved—on the one hand, since the mat does not have to be fully heated up to the outside in the heating device and, on the other hand, since the energy loss between the heating device and the pressing station can be reduced.

In accordance with an advantageous embodiment of the invention, at least one additive, in particular a catalyst for the binder contained in the mat, is also introduced into the mat from the interior of the mat outwardly to the surface of the mat.

An acceleration of the bonding process which takes place in the mat can be achieved by the supply of one or more additives, likewise from the interior of the mat outwardly to the surface of the mat. Due to the supply of the additives from the interior of the mat, the thickness of the mat to be penetrated is reduced so that a more uniform penetration of the mat by the additives is effected. Particularly the inner critical region of the mat is penetrated by the additives in an ideal manner in accordance with the invention.

The said object is further satisfied by two initially separate mats being scattered to form the mat, with these two separate mats being brought together such that the sides of the separate mats confronting one another form the interior of the mat and the sides of the separate mats remote from one another form the upper and lower sides of the mat respectively.

In accordance with the invention, two initially separate mats are generated which are brought together to form a single total mat. The sides of the separate mats contacting one another after the bringing together thus form the interior region and the sides remote from one another the upper and lower sides of the total mat. The two separate mats can thus be heated from their respectively confronting sides, which later form the inner region of the complete mat, by applying thermal energy from these sides toward the sides of the separate mats remote from one another.

The bringing together of the separate mats can be effected by a machine or also manually. For example, one of the separate mats can be transported on a transportation device designed, for example, as a conveyor belt, while the second mat can be manually placed from above onto the lower mat lying on the transportation device.

Instead of a separate scattering of two mats, in accordance with the invention a mat having a mat-like construction can be used which is cut up essentially parallel to its upper and lower sides, with the supply of heat taking place through the cut surfaces, both in the direction towards the upper side of the mat and also in the direction towards the lower side of the mat. For this purpose, a separating apparatus, which is in particular formed as a cutting apparatus, is preferably provided with which the mat can be divided into at least two part mats, in particular into an upper part mat and a lower part mat, with the heating device being arranged in the region between the part mats.

The part mats preferably have substantially the same thickness in this arrangement, so that a uniform through-heating of the mat is achieved from the inside to the outside, both to the upper side of the mat and also to the lower side of the mat. The heating device thereby advantageously lies directly against the cut surfaces of the part mats, since, in this way, an energy loss is largely avoided.

The separating apparatus is preferably formed as a saw, in particular as a band saw, and preferably as an endless band saw, with the cutting direction of the cutting apparatus expediently being directed opposite to the transport direction of the mat substantially parallel to the surface of the forming line. In this manner, a simple supply of the thermal energy is possible from the interior of the mat to the outside. Furthermore, the separation of the mat into two part mats can take place directly during the transport of the mat on the forming line in the direction of the press station without the transport process having to be interrupted or impaired in some other manner. Thus, the invention can be used both for the continuous manufacture of shaped bodies and also for the discrete manufacture of shaped bodies.

The mat is preferably prepressed prior to the preheating, since, in this manner, a tearing apart or falling apart of the fiber components of the mat is avoided during the cutting process. Furthermore, the invention is preferably used with mats which are made of fibers and not, for example, of shavings, since fibers mat together during the prepressing and thus endow the mat with a strength which is advantageous for the subsequent cutting process.

In accordance with a further advantageous embodiment of the invention the heating device includes a heating chamber which extends substantially over the full width of the mat and which has, in its regions confronting the part mats, in each case outlet openings, in particular slot-like outlet openings, for the dispensing of the heating medium, in particular of steam, from the heating chamber into the mat.

The preheating of the mat over its entire width can be carried out very simply and uniformly by the heating chamber. Furthermore, the outlet openings can be made at least partly closeable, in particular via a slider element, so that both a control of the quantity of the emerging heating medium as well as the location at which the heating medium emerges within the mat can be adjusted.

Advantageously, the heating device should be provided as close as possible to the entry to the press so that both the heat supply and, optionally, the introduction of the additives into the mat are effected directly prior to its entering into the nip.

It is furthermore possible to cut the mat asymmetrically, that is, into part mats of varying thickness, or correspondingly to bring together part mats scattered with different thicknesses into one uniform mat. It is furthermore possible to generate not only two, but a plurality of part mats, with these having different or identical thicknesses.

To reduce the friction between the part mats and the heating device, an oscillating device can be provided in accordance with the invention or the heating apparatus can be set into oscillation. The heating device can advantageously be coated, in particular at its contact points to the part mats, with thermal insulating material, for example with Teflon or the like. In this way, a premature curing or tendency to cure of the binder contained in the mat material can be avoided. The heating device can also contain, for example, sections, in particular chambers with a cooling medium, for example cooled air, instead of or in addition to insulating material.

A heating device designed in accordance with the invention can also be designed for the supply of thermal energy and/or additives in the opposite direction, i.e. from the exterior of the mat to its interior. Instead of supplying the heating medium and/or the additives via the openings of the heating device provided, for example, at the side, a vacuum can be generated at these openings, for example by the connection of a vacuum apparatus. By means of the vacuum generated in this way within the heating device, a heating medium and/or corresponding additives can be supplied to the upper side and/or lower side of the mat, whereupon they are conveyed through the respective part mat from the exterior to the interior of the mat due to the vacuum.

The invention will be explained in more detail in the following with reference to an embodiment and to the drawings.

DESCRIPTION OF THE PREFERRED EMBODIMENTS

Figure 1:
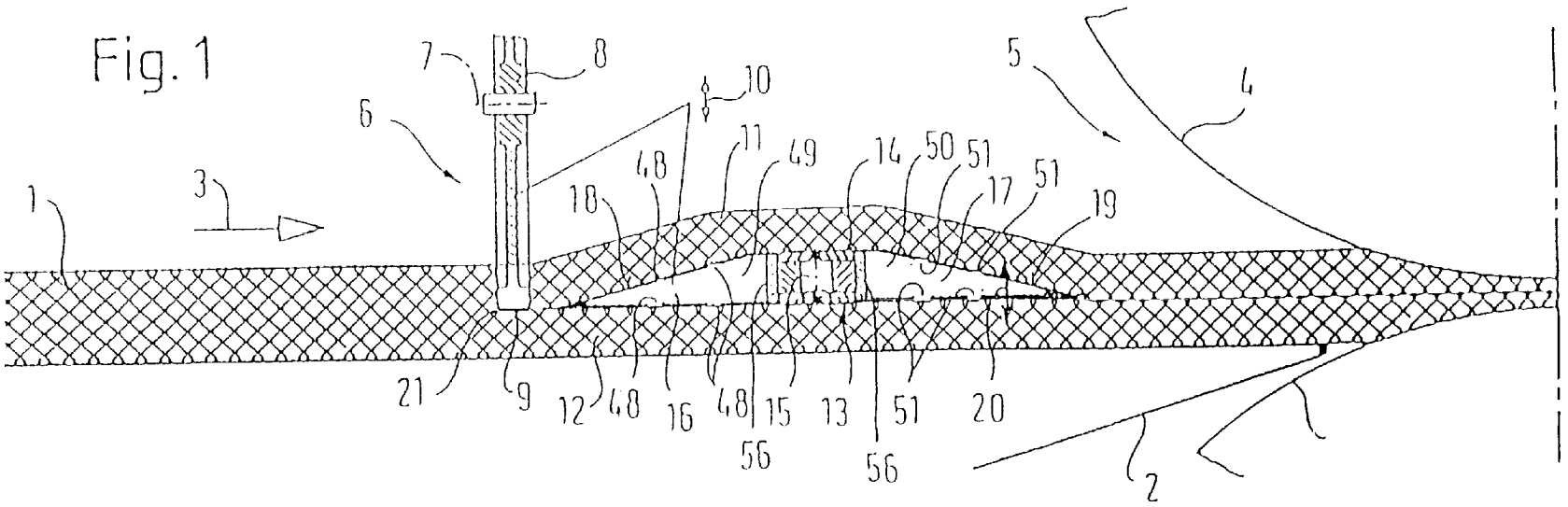
FIG. 1 is a longitudinal section through a heating device formed in accordance with the invention, having a band saw provided upstream of it.

FIG. 1 shows a mat 1 which is scattered onto a forming line 2 formed as an endless recirculating conveyor belt and is transported in the direction of the arrow 3 to a pressing station 5 formed by two press rollers 4, of which only sections are shown.

The mat 1 is exposed to pressure and heat via the press rolls 4, so that the desired shaped body in the form of boards emerges at the output of the pressing station 5.

A partly shown band saw 6 is arranged upstream of the pressing station 5 in the transport direction and is indicated by a partly illustrated deflection roll 8 rotatable about an axis 7 and also by an endless saw blade 9 which is guided around the outer side of the deflection roll 8.

The band saw 6 with its saw blade 9 is vertically adjustable, as is indicated by a double arrow 10. In FIG. 1 the position of the band saw 6 is set so that the saw blade 9 comes to lie approximately at the center of the height of the mat 1, with the teeth 21 of the saw blade 9 being directed against the transport direction of the mat shown by the arrow 3, as can be recognized from FIG. 2. In this arrangement, the saw blade 9 extends substantially horizontally and in a straight line over the entire width of the mat 1 (see likewise FIG. 2), so that the mat 1 is cut up during a movement along the arrow 3 by the saw blade 9 into an upper and a lower part mat 11, 12 each having substantially the same thickness.

In the region between the band saw 6 and the pressing station 5 there is provided a heating device 13 which is arranged between the upper and lower part mats 11, 12.

The heating device 13 comprises a hollow rail 14 with a heating chamber 15 which extends over the entire width of the mat 1 and also a broadening device 16 which adjoins the hollow rail 14 opposite to the transport direction 3 and a uniting device 17 which follows the heating chamber 15 in the transport direction 3.

The broadening device 16 has a run-up ramp 18 which drops off against the transport direction 3 and is of adjustable height, together with the band saw 6, as is indicated by the double arrow 10. The interior of the broadening device 16 is designed as a hollow cavity 49 which is in communication with the lower side of the upper part mat 11 via additional outlet openings 48 which are made in the run-up ramp 18 and can be designed, for example, as slots, bores or other apertures. In addition to or instead of the hollow cavity 49, the broadening device 16 can be filled with thermal insulating material in its interior. Both the upper side and the lower side of the broadening device 16 can be coated with thermal insulating material or made thereof. The same applies to the partition wall 56 laterally bounding the broadening device 16.

The uniting device 17 has a down ramp 19 which drops away in the transport direction 3 and is of adjustable height, as is indicated by the double arrow 20. Since the lower part mat 12, which is led between the forming line 2 and the lower side of the uniting device 17, expands in thickness as a result of the heating by the heating device 13, the friction between the part mat 12 and the lower side of the leading together device 17 is increased. This friction can be reduced by displacing the uniting device 17 upward. The interior of the uniting device 17 is also designed as a hollow cavity 50 which is in communication with the lower side of the upper part mat 11 via additional outlet openings 51 made in the down ramp 19.

Figure 2:
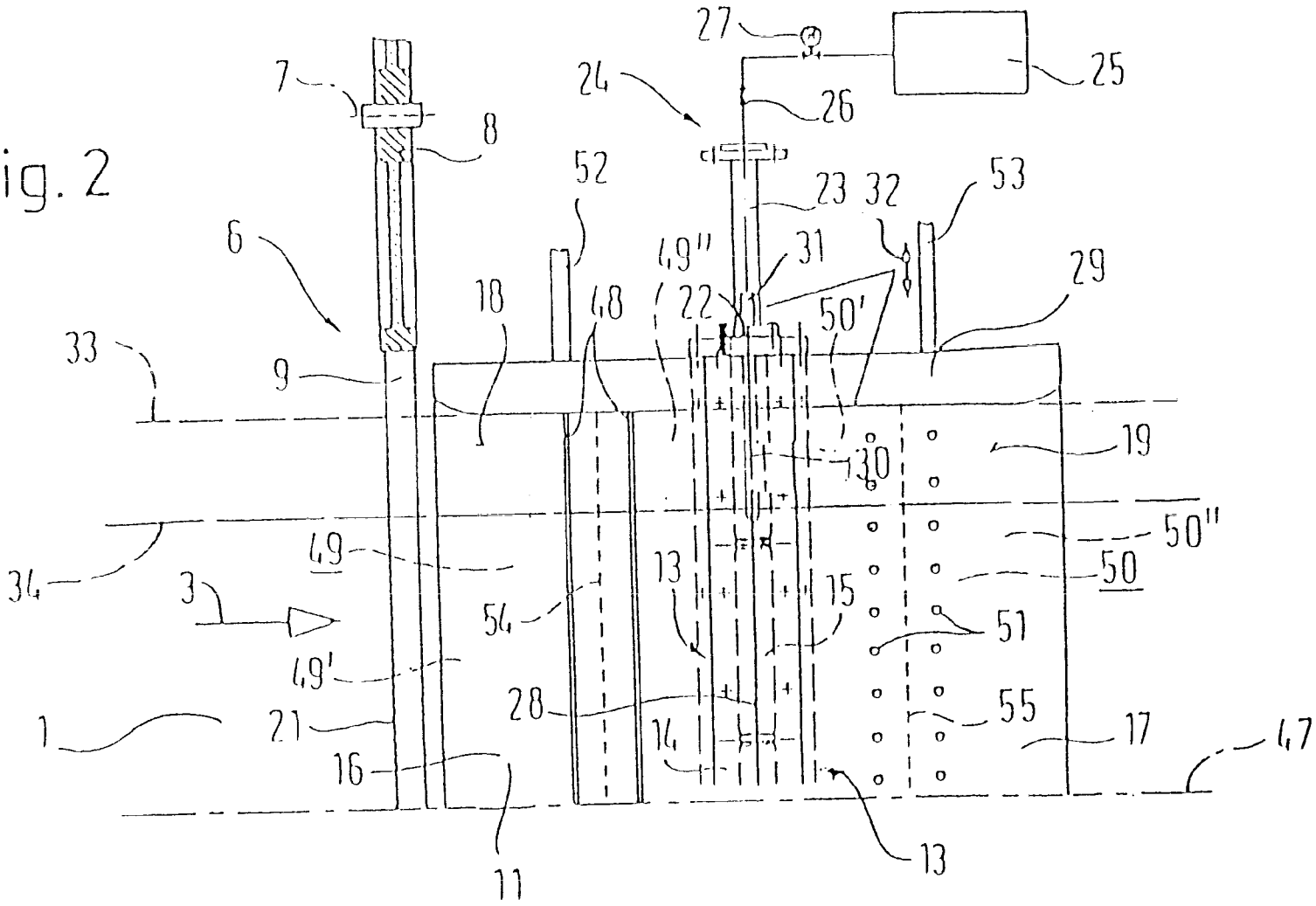
FIG. 2 is a plan view of the apparatus of FIG. 1.

In FIG. 2 there is shown a plan view on the apparatus of FIG. 1 with only one-half of the apparatus being drawn in. The apparatus can basically be of mirror symmetrical design relative to an axis 47.

It can be seen from FIG. 2 that a supply means 24 comprising a conduit 23 is provided at the end face region 22 of the hollow rail 14 via which a heating medium can be supplied from a heating medium store or generator 25 to the heating chamber 15. In this arrangement, the supply of the heating medium can be controlled via a valve 26 and also via a pump 27.

At the top side of the hollow rail 14, and also at the bottom side which cannot be recognized in FIG. 2, there is formed a slot-like outlet opening 28 which extends over the entire width of the forming line 2 and of the mat 1 through which heating medium introduced into the heating chamber 15 emerges and can thereby penetrate the part mats 11, 12.

Furthermore, the additional outlet openings 48 and 51 can be seen in FIG. 2. By way of example, the additional outlet openings 48 are made slot-like and the additional outlet openings 51 as bores. Additives, which are introduced into the hollow cavities 49, 50 via pipes 52, 53, can be introduced into the part mats 11, 12 through the additional outlet openings.

Furthermore, it is indicated by broken lines 54, 55 in FIG. 2 that the hollow cavities 49, 50 can also be subdivided into a plurality of hollow cavities 49', 49", 50', 50" so that different additives can be introduced into the part mats. In this case, a corresponding number of different pipes can be provided which transport the additives. The partition walls 54, 55 can extend perpendicularly or horizontally to the direction of transport 3 or in any other direction. The direction indicated in FIG. 2 perpendicular to the direction of transport 3 of the mat is preferred since in this way each of the hollow cavities 49', 49", 50', 50" formed extends over the total width of the mat 1 and the additives can thus be introduced into the whole mat 1.

A guide and sealing panel 29 is provided in the end face region 22 of the hollow rail 14. It bounds the mat 1 laterally and prevents a lateral escape of heating medium from the mat 1. In this arrangement, the guide and sealing panel 29 is in each case inclined and in particular rounded at its ends at the side adjacent the mat 1, in order to prevent the side edge of the mat 1 being turned into fibers.

An elongate guide 30 for a blocking slide 31, by which the outlet opening 28 can be closed over a partial region, is formed at the topside of the hollow rail 14. In this arrangement the blocking slide 31 is displaceable together with the guide and sealing panel 29 along a double arrow 32 so that the apparatus is adjustable to mat widths which lie between two maximum and minimum widths indicated by the broken lines 33, 34.

Figure 3:
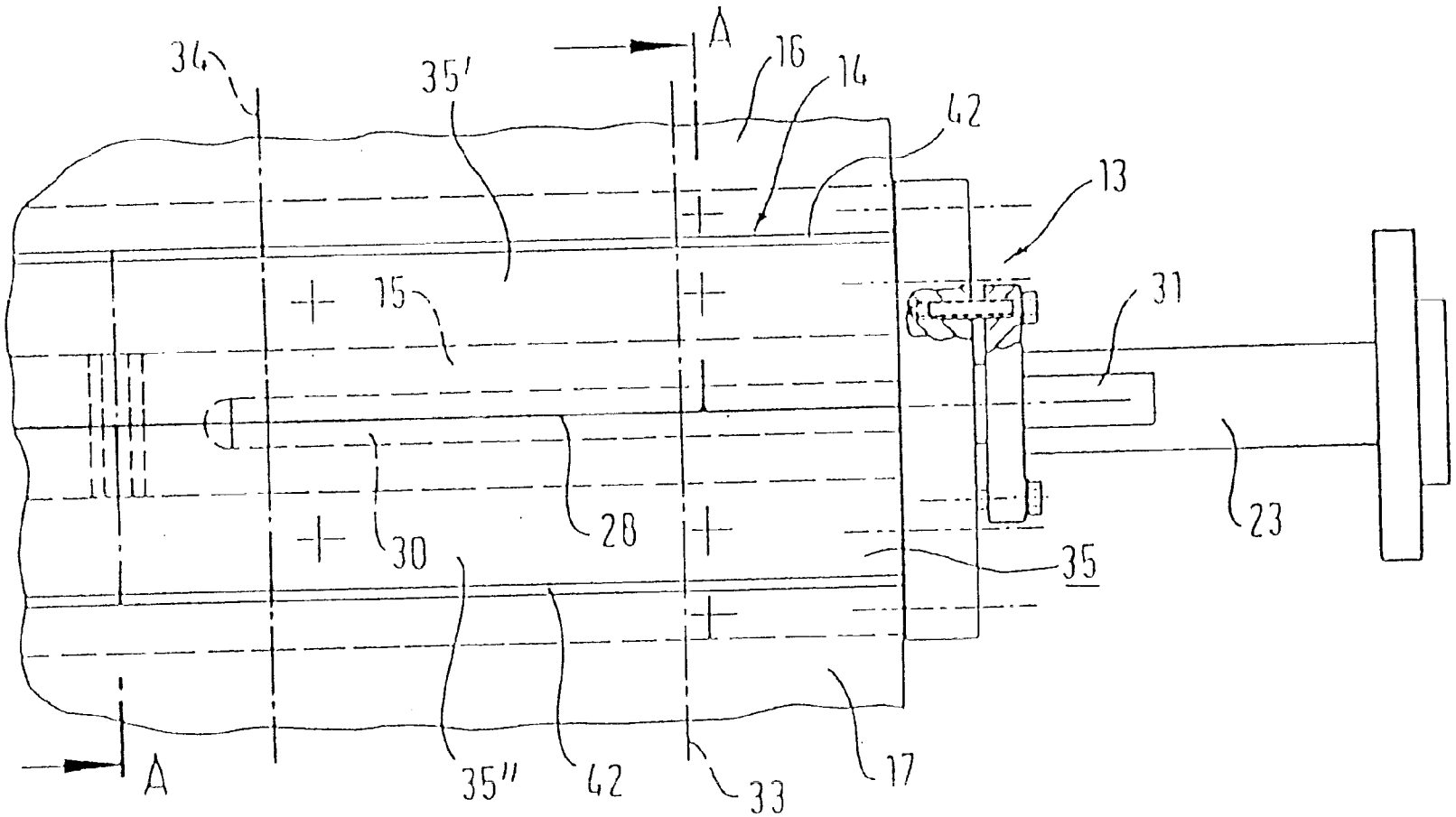
FIG. 3 is a partial view of the plan view of FIG. 2 to a larger scale.
Figure 4:
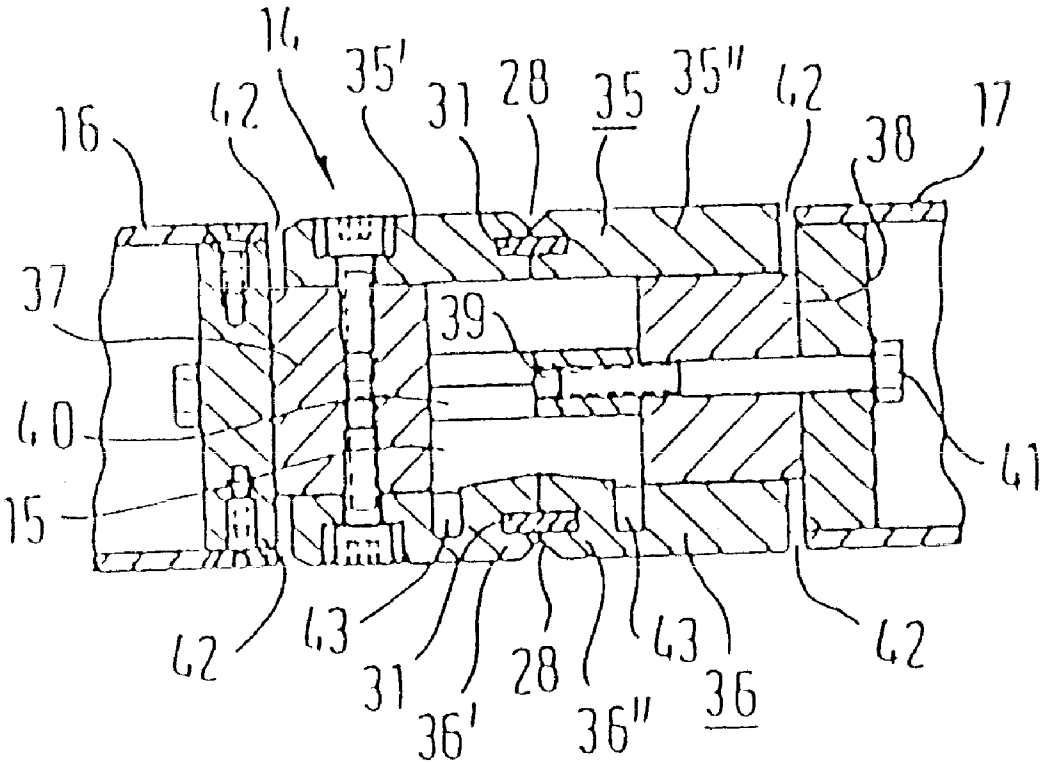
FIG. 4 is a sectional view taken along line A—A of FIG. 3.

It can be seen from FIG. 3, and in particular from FIG. 4, that the hollow rail 14 has a cover plate 35 and also a base plate 36 which each consist of two separate sections 35', 35", and 36' and 36". The sections 35' and 35" and 36' and 36" are each arranged at a small spacing from one another so that the slot-like outlet openings 28 are formed between these sections both at the topside and also at the bottom side of the hollow rail 14. It is fundamentally also possible to make the cover plates and base plates 35, 36 in one piece and for the outlet opening 28 to be formed as bores or as slot-like openings which do not extend up to the side ends of the cover and base plates 35, 36.

Furthermore, it can be seen from FIG. 4 that both the upper outlet opening 28 and also the lower outlet opening 28 are each closeable over a partial region by a blocking slide 31.

The sections 35', 36' of the cover plate 35 and of the base plate 36 respectively are secured to a common side wall 37, while the sections 35" and 36" are connected to a common side wall 38 of the hollow rail 14. In this arrangement the connection can in each case take place via screws or other fastener elements.

A projection 40 including a thread 39 is formed at the inner side of the side wall 37 into which a screw 41 led through the side wall 38 engages. In this arrangement, the screw 41 is so connected to the side wall 38 that, on removing the screw 41 from the projection 40, the side wall 38 and the sections 35" and 36" of the cover and base plates 35, 36 connected to it are displaced, so that the width of the outlet openings 28 increases. The width of the outlet opening 28 can be made correspondingly smaller by screwing in the screw 41.

In order to enable a shift and thus the setting of the width of the outlet openings 28, air gaps 42 are in each case provided between the lateral outer edges of the cover and base plates 35, 36 and the adjoining broadening device 16 and the uniting device 17 respectively.

Two run-off channels 43 extending over the width of the hollow rail 14 are in each case formed in the base plate 36 in which condensate which forms in the heating chamber 15 deposits and is transported away.

Figure 5:
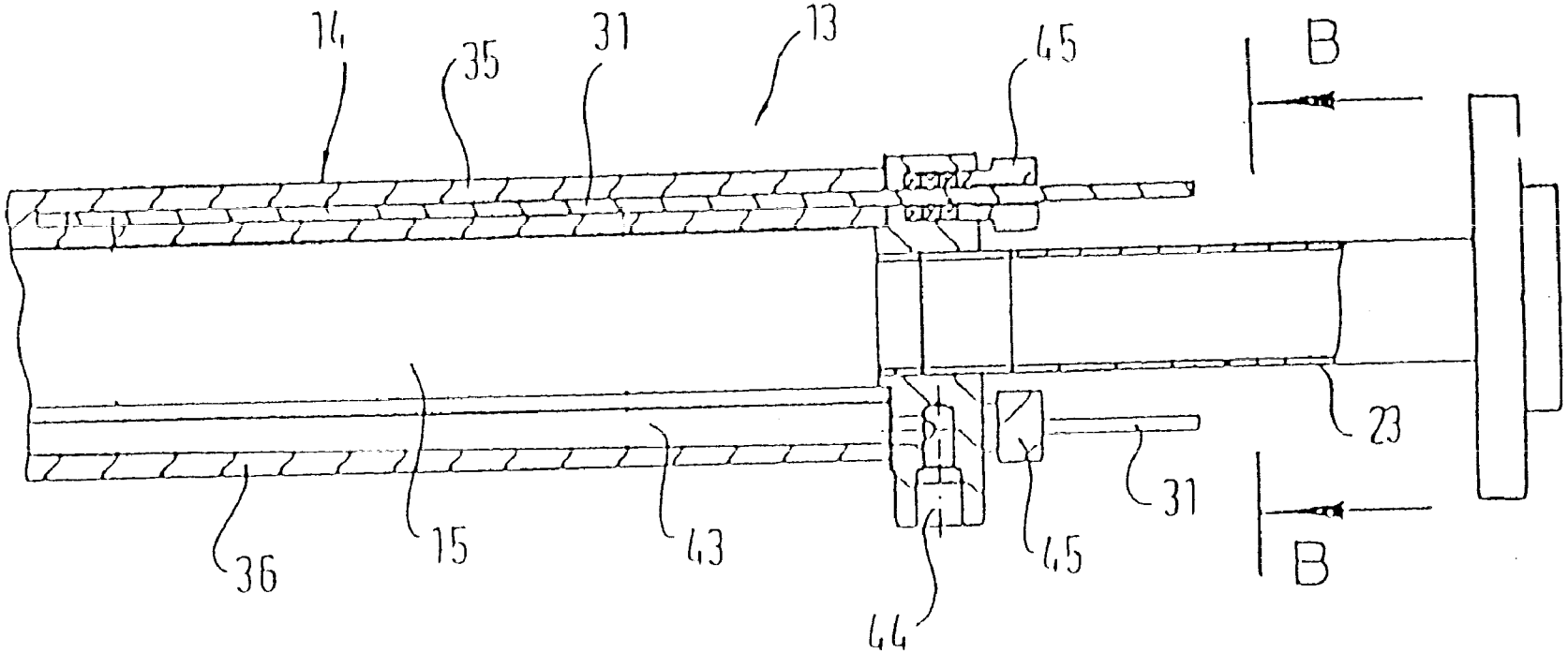
FIG. 5 is a side view of the apparatus of FIG. 3.

It can be seen from FIG. 5 that the run-out channels 43 are connected to a run-out opening 44 via which the condensed heating medium can be led away from the heating device 13.

Furthermore it can be seen from FIG. 5 that the blocking slide 31 is guided in stuffing boxes 45 which are, for example, formed of Teflon or of another suitable material in order to ensure the sealed nature of the heating device 13.

Figure 6:
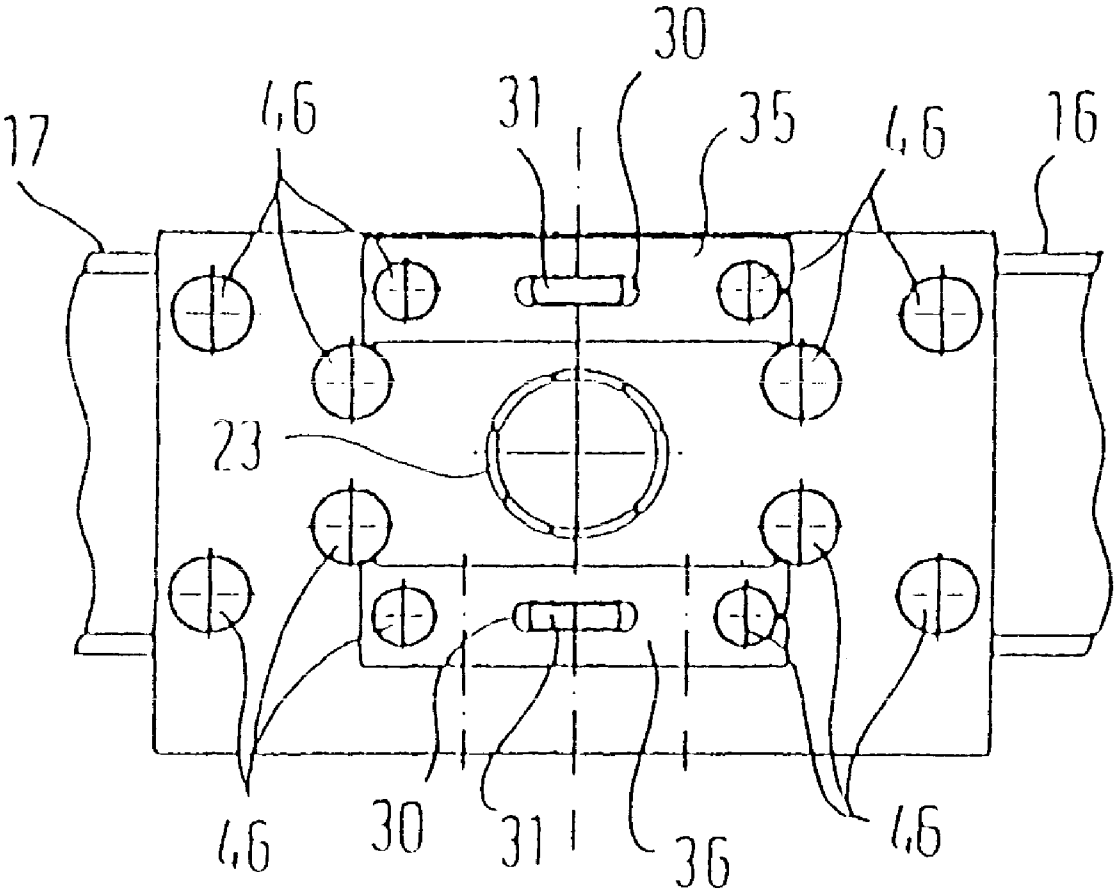
FIG. 6 is a sectional view taken along line B—B of FIG. 5.

FIG. 6 shows that guides 30 for the blocking slide 31 are formed both in the cover plate 35 and also in the base plate 36, so that both the outlet openings 28 formed in the cover plate 35 and also the outlet openings formed in the base plate 36 can be partly closed via the blocking slide 31.

Furthermore, the attachment of the cover plate 35, of the base plate 36 and also of the side walls 37, 38 and of the broadening and uniting devices 16, 17 to a common end side wall 46 via fastener elements, in particular screws 46, can be seen in FIG. 6.

In the following the method in accordance with the invention of the method in accordance with the invention will be described in more detail.

After the mat 1 has been scattered via a scattering apparatus onto the forming line 2 and precompressed by a non-illustrated prepressing unit, it is transported along the arrow 3 in the direction of the pressing station 5. The moisture content of the mat thereby amounts to approximately 8%.

The mat 1 is split up into two part mats 11, 12 of substantially the same thickness due to the mat 1 running against the teeth 21 of the endless recirculating saw blade 9 of the band saw 6. The two part mats 11, 12 separate from one another by running up onto the run-up ramps 18 of the broadening device 16. An additive, for example a catalyst for the binder contained in the mat 1, is fed into the hollow cavity 49 formed inside the broadening device 16 via the pipe 52 and introduced into the part mats 11, 12 via the additional outlet openings 48.

Heating medium, for example saturated steam, is introduced into the heating chamber 15 via both ends of the hollow rail 14 and passes upwardly and downwardly from the heating chamber 15 via the outlet openings 28 formed in the cover and base plate 35, 36 and through the part mats 11, 12 so that these are heated. The part mats 11, 12 are thereby heated to a temperature of up to ca. 80 to 90° with this temperature being achieved at the respective cut surface of the part mats 11, 12, up to a position close to the respective outer surface. The moisture content of the part mats 11, 12 amounts after heating to, for example, 10%.

Instead of or in addition to the additive contained in the hollow cavity 49, one or more additives can be introduced into the hollow cavity 50 via the pipe 53 and introduced via the additional outlet opening 51 into the part mats 11, 12 after they have been heated. It is generally also possible for additives to be introduced into the part mats 11, 12 together with the heating medium via the heating chamber 15 and the outlet opening 28.

After passing the hollow rail 14, the upper part mat 11 slides downwardly along the down ramp 19 so that the two part mats 11, 12 come to lie against one another at the end of the uniting device 17 without disturbing action, since the surfaces of the broadening device 16, of the hollow rail 14 and of the uniting device 17 merge into one another substantially continuously without disturbing steps.

Following this, the two part mats 11, 12 are pressed in the pressing station 5 under pressure and with renewed supply of heat into the desired shaped body. In this arrangement heat is supplied via the press rolls 4 and the upper and lower sides of the mat 1 in the direction of the inner side, so that a uniform heat gradient is produced over the entire mat thickness as a result of the heat already present in the interior of the mat 1.

Typical dimensions for the heating device are for example 1 m length in the transport direction, with the guide and sealing panels typically having the same length. Instead of the guide and sealing panels, co-running endless belts can for example also be used in order to avoid the friction at the outer edges of the mat.

The vapor treatment chamber can for example have a cross-sectional area of 60×60 $mm^2$ and a width of for example ca. 1.20 m to 2.30 m. Depending on the application these dimensions can also be increased or reduced, so that the vapor treatment chamber can for example have a cross-sectional area of between 30×30 and 200×200 $mm^2$.

Figure 7:
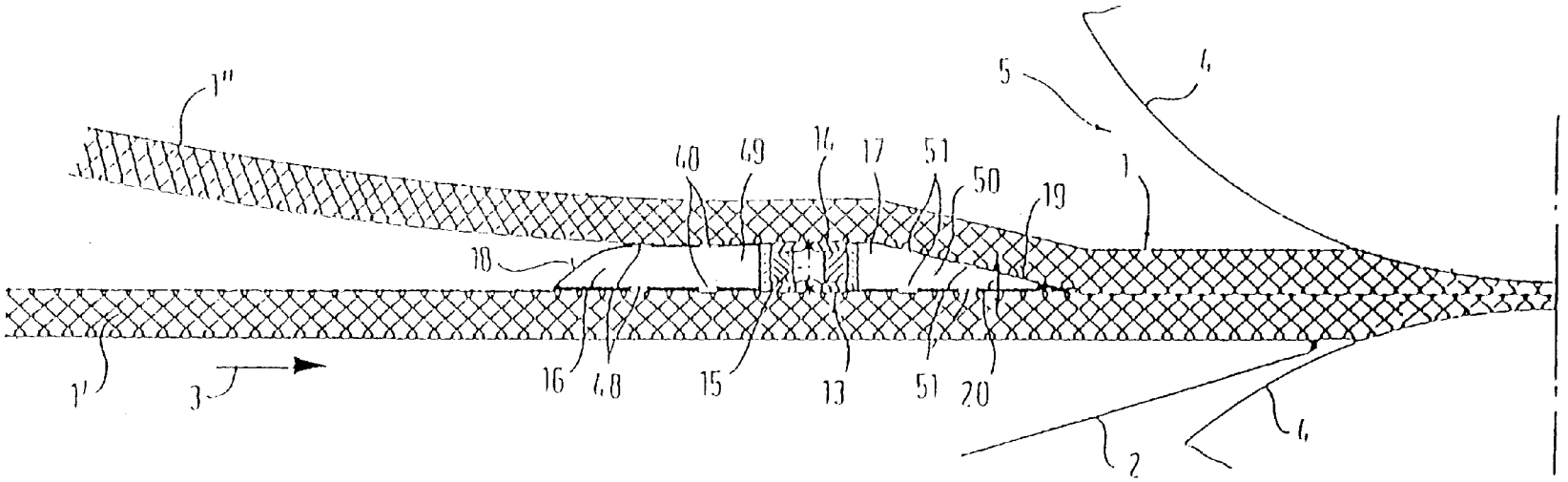
FIG. 7 is an elongate section through a further embodiment of the invention.

FIG. 7 shows a variant of an apparatus made in accordance with the invention similar to the embodiment shown in FIG. 1 so that identical parts are provided with the same reference numerals as in FIG. 1.

The embodiment shown in FIG. 7 differs from the embodiment illustrated in FIG. 1 and FIG. 2 in that two separately scattered mats 1', 1" are supplied to the heating device 13 instead of one uniform mat 1. The supply of the upper separate mat 1" can be effected either manually or by a transportation apparatus (not shown) such as an endless conveyor belt.

The two separate mats 1', 1" are generally charged with additives and a heating medium in an analogous manner to the methods described in FIGS. 1 and 2 and, after they have been brought together to form a common mat after passing the heating device, are supplied to the pressing station 5 for pressing into the desired shaped bodies.

To achieve a simultaneous transportation of the separate mats 1', 1", first the lower separate mat 1' can be displaced at the start of the method up to the nip formed between the pressing rolls, whereupon the upper separate mat 1" is displaced so far over the surface of the heating device 13 in the direction of the nip until it also reaches this. Subsequently, for example, the two press rolls 4 can be set into rotation so that the two front ends of the separate mats 1', 1" are gripped and smoothly pulled into the nip together as a uniform mat. At this point in time or even before it, the supply of the heating medium and of the additives can take place so that the two separate mats 1', 1" are penetrated by both the heating medium and the additives.

What is claimed is:

1. A method of manufacturing of shaped bodies, in particular fiberboard and chipboard, in which fibers, particles containing cellulose or particles containing lignocellulose with an admixed binder are scattered to form a mat (1) and preheated before the mat (1) is pressed to the shaped body while supplying heat and pressure, characterized in that the preheating of the mat (1) consisting of the pre-compacted or pre-pressed fibers or like particles takes place by the supply of thermal energy from the interior of the mat (1) outwardly to the surface of the mat (1).

2. A method in accordance with claim 1, characterized in that at least one additive, in particular a catalyst for the binder contained in the mat (1), is also introduced into the mat (1) from the interior of the mat (1) outwardly to the surface of the mat (1) and/or in that the pre-heating is effected by the supply of a heated thermal medium, in particular of a fluid thermal medium, advantageously in the form of hot air or saturated or superheated steam.

3. A method in accordance with claim 1 characterized in that two separate mats (1', 1") are first scattered, pre-compacted or pre-pressed to form the mat (1) and in that these two separate mats (1', 1") are each brought together such that the sides of the mats (1', 1") facing one another form the interior of the mat (1) and the sides of the mats (1', 1") remote from one another form the upper side and the lower side of the mat (1) respectively.

4. A method in accordance with claim 3, characterized in that the supply of the thermal energy and, optionally, the introduction of the additives, is effected directly prior to the bringing together of the mats (1', 1").

5. A method in accordance with claim 1 characterized in that the mat (1) has a mat-like build-up, in that it is cut open substantially parallel to its upper side and its lower side and in that, where applicable, the introduction of the additive is effected through the cut surfaces both in the direction of the upper side and the lower side of the mat (1).

6. A method in accordance with claim 2 characterized in that the introduction of the additives into the mat (1) is effected by injection through a nozzle.

7. A method in accordance with claim 2 characterized in that the additive is introduced into the mat (1) in dissolved form as a fluid, in particular in liquid form.

8. A method in accordance with claim 2 characterized in that the additive is introduced into the mat (1) prior to and/or simultaneously with and/or subsequent to the pre-heating of said mat (1).

9. A method in accordance with claim 2 characterized in that hardeners are used as the additives, in particular ammonium chloride, ammonium sulfate, ammonium nitrate and/or hexamethylene tetramine, and/or formic acid, maleic acid, citric acid, sulfuric acid, hydrochloric acid, aluminum sulfate (chloride), persulfate, phosphoric acid; and/or water repellent agents such as paraffin; and/or wood preservatives, fungicides; and/or fire protection agents; and/or formaldehyde scavengers such as urea; and/or dilutants; and/or dyes.

10. A method in accordance with claim 1 characterized in that the mat (1) is pre-pressed prior to the pre-heating and/or the introduction of the additive.

11. An apparatus for the manufacture of shaped bodies, in particular of fiberboard and chipboard, by scattering fibers, particles containing cellulose or particles containing lignocellulose and a binder to form a mat and preheating the mat, the apparatus comprising a scattering station, a forming line (2), a pressing station (5) and a heating device (13) inserted before the pressing station (5) for the heating of a mat (1) scattered by the scattering station onto the forming line (2) prior to entry into the pressing station (5), characterized in that the heating device (13) supplies heat from the interior of the mat (1) outwardly toward the surface of the mat (1).

12. An apparatus in accordance with claim 11 characterized in that the heating device (13) is designed for the introduction of additives, in particular of a catalyst for the binder contained in the mat (1), into the mat (1) also from the interior of the mat (1) outwardly toward the surface of the mat (1).

13. An apparatus in accordance with claim 11 characterized in that a separating device, in particular formed as a cutting device (6), is provided with which the mat (1) can be divided into at least two part mats, in particular into a lower and an upper part mat (11, 12), and in that the heating device (13) is arranged in the region between the part mats (11, 12).

14. An apparatus in accordance with claim 13 characterized in that the separating device is formed as a saw (6), in particular as a band saw, and preferably as an endless band saw.

15. An apparatus in accordance with claim 13 characterized in that the cutting direction of the cutting device (6) is directed opposite to the transport direction of the mat (1) substantially parallel to the surface of the forming line (2).

16. An apparatus in accordance with claim 13 characterized in that the separating device (6) is arranged upstream of the heating device (13) in the transport direction of the mat (1).

17. An apparatus in accordance with claim 11 characterized in that the heating device (13) includes a heating chamber (15) which extends substantially over the full width of the mat (1) and which has respective outlet openings in its regions adjacent to the part mats (11, 12), in particular slit-like outlet openings (28), for the dispensing of heating medium, in particular of steam, from the heating chamber (15) into the mat (1) and optionally includes additive outlet openings (48, 41) for the introduction of the additives into the mat (1).

18. An apparatus in accordance with claim 17 characterized in that the outlet openings (28) are made at least partly closable, in particular via a blocking slide (31).

19. An apparatus in accordance with claim 17 characterized in that the size of the outlet openings (28) is adjustable.

20. An apparatus in accordance with claim 17 characterized in that the heating chamber (15) includes at least one lateral supply means (24), in particular disposed outside of the mat (1), for the supply of the heating medium.

21. An apparatus in accordance with claim 17 characterized in that supply means (24) for the supply of heating medium are provided at the two end faces of the heating chamber (15).

22. An apparatus in accordance with claim 17 characterized in that a broadening device (16) is provided upstream of the heating chamber (15) in the transport direction, in particular a broadening device (16) having ramps (18) for the expansion of the spacing between the part mats (11, 12), and in that, where applicable, the additional outlet openings (48) are made in the broadening device, in particular in the run-up ramp (18).

23. An apparatus in accordance with claim 17 characterized in that a uniting apparatus (17) is arranged in the transport direction downstream of the heating chamber (15), in particular a uniting device (17) with a down ramp (19) for the simultaneous uniting of the part mats (11, 12) to a complete mat, and in that, where applicable, the additional outlet openings (51) are made in the uniting device, in particular in the down ramp (19).

24. An apparatus in accordance with claim 17 characterized in that the outlet openings (28) simultaneously form the additional outlet openings (48, 51).

25. An apparatus in accordance with claim 22 characterized in that the broadening device (16) and/or the uniting device (17) comprise(s) a plurality of sections, in particular completely separated from one another, and preferably formed as hollow spaces (49', 49", 50', 50").

26. An apparatus in accordance with claim 11 characterized in that at least one boundary unit impermeable to the heating medium, in particular in the form of a guide and sealing panel (29), is provided to the side of the mat (1) in the region ofthe heating device (13).

27. An apparatus in accordance with claim 26 characterized in that the boundary unit is displaceably formed, and in particular is displaceable together with the blocking slide (31).

28. A heating device for pre-heating a mat made of at least one of fibers, particles containing cellulose and particles containing lignocellulose and a binder and a heating device for the heating of a mat supplying heat from an interior of the mat outwardly toward a surface of the mat.

29. A method for manufacturing a shaped body made with at least one of fibers, particles containing cellulose and particles containing lignocellulose and an admixed binder forming a mixture, the mixture comprising scattering the mixture to form a mat, preheating the mat by supplying thermal energy from an interior of the mat outwardly to a surface of the mat, and thereafter pressing the mat into the shaped body.

30. Apparatus for manufacturing a shaped body having at least one of fibers, particles containing cellulose and particles containing lignocellulose and admixed with a binder into a mixture, the apparatus comprising a scattering station for forming a mat with the mixture, a heating device for supplying heat from an interior of the mat outwardly toward a surface of the mat, and a pressing station downstream of the heating device for pressing the heated mat into the shaped body.

* * * * *